US005612654A

United States Patent [19]

Tsujiguchi et al.

[11] Patent Number: 5,612,654

[45] Date of Patent: Mar. 18, 1997

[54] DIELECTRIC FILTER HAVING STEPPED RESONATOR HOLES WITH OFFSET HOLE PORTIONS

[75] Inventors: Tatsuya Tsujiguchi; Hitoshi Tada, both of Kyoto, Japan

[73] Assignee: Murata Manufacturing Co., Ltd., Japan

[21] Appl. No.: 377,394

[22] Filed: Jan. 24, 1995

[30] Foreign Application Priority Data

Jan. 25, 1994 [JP] Japan ..... 6-006399
Mar. 23, 1994 [JP] Japan ..... 6-051979

[51] Int. Cl.[6] ..... H01P 1/202

[52] U.S. Cl. ..... 333/202; 333/206

[58] Field of Search ..... 333/202, 206, 333/207, 222, 223, 202 DB

[56] References Cited

U.S. PATENT DOCUMENTS 5,124,676 6/1992 Ueno ..... 333/222 X

FOREIGN PATENT DOCUMENTS

0510971A2 10/1992 European Pat. Off. .
39901 2/1987 Japan ..... 333/202 DB
92001 3/1990 Japan ..... 333/206
6069703 3/1994 Japan ..... 333/206

OTHER PUBLICATIONS

Patent Abstracts of Japan, vol. 17, No. 629 (E–1462) Nov. 19, 1993; JP–A–05 199013 (Murata Manufacturing Co. Ltd.) Aug. 6, 1993.

Patent Abstracts of Japan, vol. 13, No. 366 (E–806) Aug. 15, 1989; JP–A–01 123501 (Taiyo Yuden Co Ltd.) May 16, 1989.

*Primary Examiner*—Benny Lee

*Attorney, Agent, or Firm*—Ostrolenk, Faber, Gerb & Soffen, LLP

[57] ABSTRACT

In a dielectric block, resonator holes have steps thereby providing a portion having a larger inner diameter and a portion having a smaller inner diameter, and the smaller inner diameter portion of each resonator hole is formed on the side of a short-circuited end surface. By forming the small inner diameter portions of the resonator holes relatively close to each other, the coupling between the two resonators becomes inductive coupling. By contrast, when small inner diameter portions are formed further apart from each other, the coupling between the two resonators becomes capacitive coupling. The coupling strength can be changed by adjusting the distance between the small inner diameter portions.

21 Claims, 4 Drawing Sheets

DIELECTRIC FILTER HAVING STEPPED RESONATOR HOLES WITH OFFSET HOLE PORTIONS

BACKGROUND OF THE INVENTION

1. Field of the Invention

The present invention relates to a dielectric filter. More specifically, the present invention relates to a dielectric filter having a plurality of dielectric coaxial resonators integrally formed in a single dielectric block.

2. Description of the Background Art

Generally, in a dielectric filter having a plurality of dielectric resonators coupled to each other, when coupling between adjacent resonators is capacitive coupling, an attenuation pole is obtained in the lower frequency range of the pass band, and when the coupling between adjacent resonators is inductive coupling, an attenuation pole is obtained in the high frequency range of the pass band.

Conventionally, in order to obtain capacitive coupling, resonator holes having steps have been formed in a dielectric block, as shown in FIG. 1. In the appended figures, shadowed portions denote portions where the base material of the dielectric block appear, that is, portions which are not provided with a conductor.

Referring to FIG. 1, in a conventional dielectric filter having resonator holes with steps, two resonator holes 2*a* and 2*b*, for example, are formed piercing through a pair of opposing surfaces 1*a* and 1*b* of a dielectric block 1 having approximately a rectangular parallellepiped shape. Inner conductors 3 are formed on the inner surfaces of resonator holes 2*a* and 2*b*. A pair of input/output electrodes 5 are formed at prescribed portions on the outer surface of dielectric block 1. An outer conductor 4 is formed approximately over the entire outer surface, except the regions where the input/output electrodes 5 are formed.

At one apertured surface 1*a* (hereinafter referred to as an open end surface) of each of the resonator holes 2*a* and 2*b*, there is a portion not provided with the inner conductor 3 (hereinafter referred to as a non-conducting portion), so that the inner conductors 3 are isolated (not conducted) from the outer conductor 4. At the other apertured surface 1*b* (hereinafter referred to as a short-circuited surface), the inner conductors are short-circuited (conducted) with the outer conductor 4. Between the inner conductor 3 of each of the resonator holes 2*a*, 2*b* and the input/output electrode 5, an external coupling capacitance is generated, which external coupling capacitance provides an external coupling.

In each of the resonator holes 2*a* and 2*b*, a step 21 is provided near the center of the open end surface 1*a* and the short-circuited end surface 1*b*. The inner diameter of the resonator holes 2*a* and 2*b* from the open-end surface 1*a* to step 21 is made larger than the inner diameter of resonator holes 2*a*, 2*b* from the short-circuited end surface 1*b* to step 21. A portion having larger inner diameter on the side of the open end surface 1*a* and a portion having smaller inner diameter on the side of the short-circuited end surface 1*b* are formed coaxially. In the dielectric filter structured as described above, the coupling between two resonators formed in resonator holes 2*a* and 2*b* is capacitive coupling, and an attenuation pole is formed in the low frequency range of the pass band. By changing the ratio of the lengths of the portions having larger inner diameter and smaller inner diameter, changing the ratio of the inner diameters, and so on, of the resonator holes 2*a* and 2*b*, the degree of capacitive coupling (coupling strength) can be changed. In other words, pass band characteristics such as band width can be adjusted.

In order to obtain inductive coupling, a coupling trench 6 is formed on the outer surface of dielectric block 1, such as shown in FIG. 2. More specifically, coupling trenches 6 are formed on both major surfaces of dielectric block 1 between resonator holes 2*a* and 2*b* as shown in FIG. 2. Coupling trenches 6 extend parallel to the resonator holes 2*a*, 2*b*, from the open end surface 1*a* and terminate near the center between open end surface 1*a* and short-circuited end surface 1*b*. The outer conductor 4 is formed on the surface of each of the coupling trenches 6. Resonator holes 2*a* and 2*b* are formed to have constant inner diameter, and the step 21 such as shown in FIG. 1 is not provided. Except these points, a dielectric filter has the similar structure to that shown in FIG. 1, and description thereof is not repeated.

In the dielectric filter shown in FIG. 2, the coupling between two resonators formed in the resonator holes 2*a* and an 2*b* is inductive coupling, and attenuation pole is formed in the high frequency range of the pass band. By changing the length, width, depth, position, cross sectional shape or the like of the coupling trench 6, the coupling strength of the inductive coupling can be changed. In other words, pass band characteristics such as band width can be adjusted.

In order to obtain inductive coupling, a step or a slit has been formed on the dielectric block in place of the coupling trenches 6 described above.

When attenuation poles are to be obtained in both the low frequency range and the high frequency range of the pass band, three or more resonator holes are formed in the dielectric block, a resonator having a step is formed in order to obtain an attenuation pole in the low frequency range, and a coupling trench or the like is formed on the outer surface of the dielectric block in order to obtain an attenuation pole in the high frequency range, and thus a dielectric filter is formed.

However, in the conventional dielectric filter having resonator holes 2*a* and 2*b* with steps 21 shown in FIG. 1, the coupling between the resonators is capacitive coupling, and it was difficult to obtain inductive coupling. Further, in order to change the coupling strength, that is, filter characteristics such as bandwidth, troublesome and complicated settings have been necessary, including adjustment of the ratio of the lengths of the larger diameter portion and the smaller diameter portion, and the ratio of inner diameters of these portions, of the resonator holes 2*a* and 2*b*.

In the dielectric filter having coupling trench 6 or the like formed on the outer surface of dielectric block 1 such as shown in FIG. 2, the outer shape of the dielectric block 1 is complicated, and therefore mounting on a substrate has been troublesome. In order to change the coupling strength, it is necessary to change the dimension, shape or the like of the coupling trench, step or the like, that is, it is necessary to change the outer shape of the dielectric block 1. More specifically, when dielectric filters having different characteristics such as different bandwidths are required, a number of dielectric blocks having different outer shapes corresponding to the required characteristics are necessary, and therefore standardization of the dielectric block is difficult. Further, reduction in size of the dielectric filter shown in FIG. 2 is more difficult than the dielectric filter shown in FIG. 1 having a step in the resonator hole of comparable characteristics, because of limitations in shaping the dielectric block.

SUMMARY OF THE INVENTION

Therefore, an object of the present invention is to provide a dielectric filter which is compact and capable of readily changing the coupling strength between adjacent resonators and changing the relation of coupling, that is, capacitive coupling or inductive coupling, without changing the outer shape or dimension of the dielectric block.

Briefly stated, in the present invention, an outer conductor is formed on an outer surface of a dielectric block having an opposing pair of surfaces, a plurality of resonator holes are formed each penetrating at least one end surface of the dielectric block and having a step consisting of a portion having larger inner diameter and a portion having smaller inner diameter with central axis of the smaller diameter portion deflected from the central axis of larger diameter portion, and an inner inductor is formed on the inner surface of each of the resonator holes.

Therefore, according to the present invention, by changing the distance between the central axis of small diameter portions of the resonator holes, the coupling strength between the resonators and coupling relation, that is, capacitive coupling or inductive coupling, can be changed.

In a preferred embodiment, the distance between central axes of smaller diameter portions of adjacent ones of the plurality of resonator holes is set smaller than the distance between central axes of larger diameter portions, whereby the coupling between the two resonators is made inductive coupling and one attenuation pole can be formed in the high frequency range of the pass band.

In another preferred embodiment, the distance between central axes of smaller diameter portions of the resonator holes is made larger than the distance between central axes of larger diameter portions, so that the coupling is made capacitive coupling, the bandwidth is made wider, and one attenuation pole can be formed in the low frequency range of the pass band.

Preferably, at least three resonators are formed in the dielectric block, the distance between smaller diameter portions of one pair of adjacent resonator holes is made smaller than the distance between the central axes of larger diameter portions to obtain inductive coupling, while the distance between central axes of smaller diameter portions of another pair of adjacent resonators is made larger than the distance between the central axes of larger diameter portions to obtain capacitive coupling, and one attenuation pole can be formed in both the high frequency range and low frequency range of the pass band.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 3A:
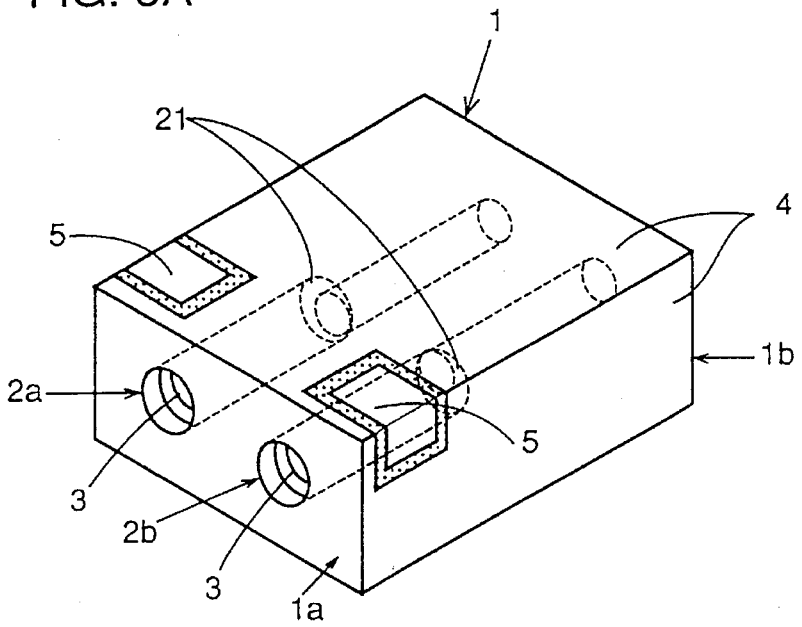
FIG. 3A is a perspective view of a dielectric filter in accordance with a first embodiment of the present invention.
Figure 3B:
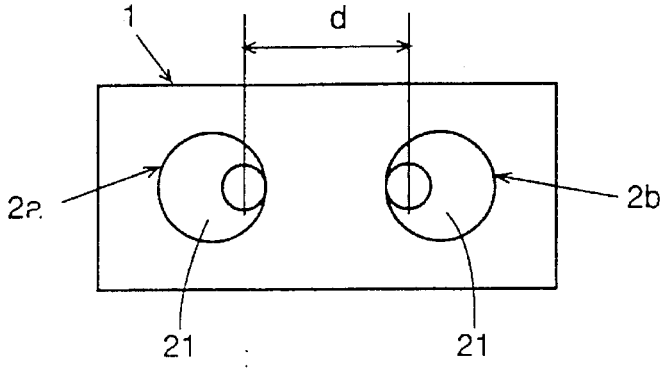
FIG. 3B is a front view taken from an open end surface of the dielectric filter in accordance with the first embodiment of the present invention.

FIG. 3A is a perspective view of a dielectric filter in accordance with a first embodiment of the present invention, and FIG. 3B is a front view taken from the open end surface of FIG. 3A.

Figure 1:
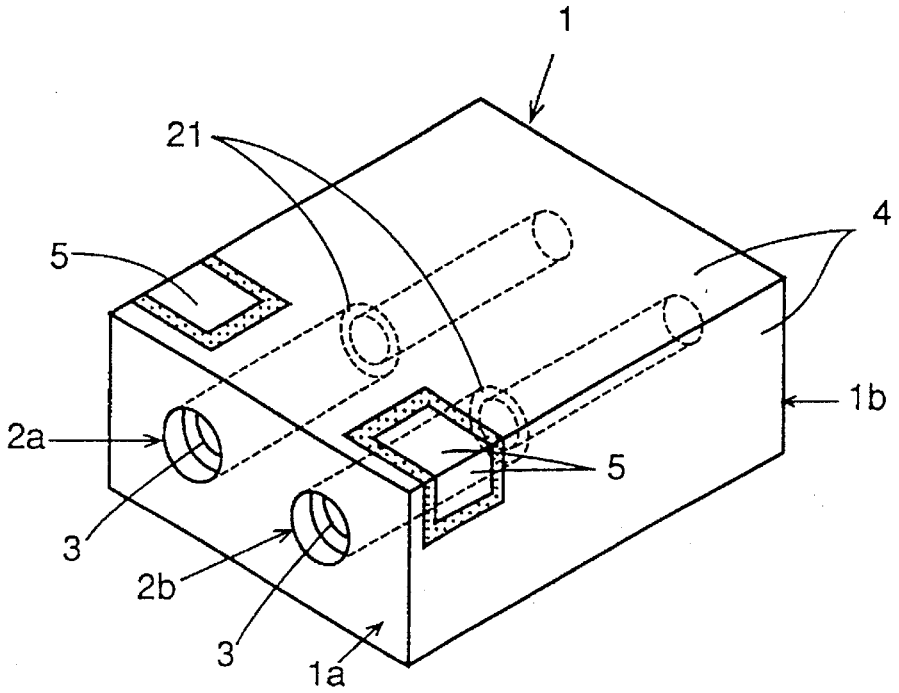
FIG. 1 PRIOR ART
FIG. 1 is a perspective view of a conventional dielectric filter having resonator holes with steps.

Similar to the dielectric filter of FIG. 1, the dielectric filter shown in FIGS. 3A and 3B includes resonator holes 2*a* and 2*b* provided with steps 21 approximately at the center between open end surface 1*a* (FIG. 3A) and short-circuited end surface 1*b* (FIG. 3A), and the inner diameter of resonator holes 2*a* and 2*b* from open end surface 1*a* (FIG. 3A) to step 21 is made larger than the inner diameter of the resonator holes 2*a* and 2*b* from short-circuited end surface 1*b* (FIG. 3A) to step 21. As shown in FIG. 3B, the inner diameter portions of resonator holes 2*a* and 2*b* on short-circuited end surface 1*b* (FIG. 3A) are formed closest to each other. More specifically, the distance d (hereinafter referred to as the width of the smaller diameter portion) between the central axes of smaller diameter portions of resonator holes 2*a* and 2*b* at the short-circuited end surface 1*b* (FIG. 3A) is made smaller than the distance (hereinafter referred to as the width of the larger diameter portion) between the central axes of larger diameter portions of the resonator holes on the open end surface 1*a* (FIG. 3A). Except these points, the dielectric filter has similar structure as the conventional example shown in FIG. 1, and description thereof is not repeated.

In the structure shown in FIGS. 3A and 3B, the coupling between the two resonators formed at resonator holes 2*a* and 2*b* is inductive coupling, and one attenuation pole is formed in the high frequency range of the pass band.

Figure 4:
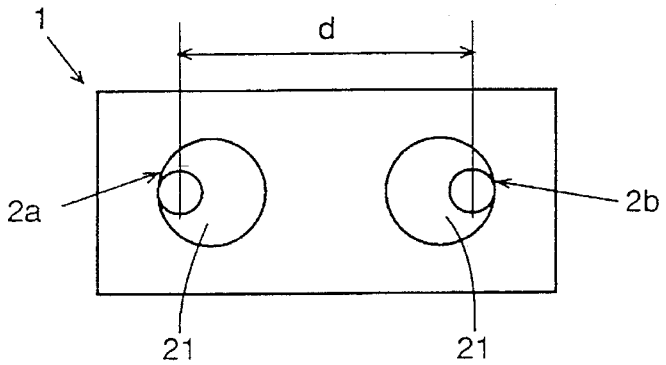
FIG. 4 is a front view taken from the open end surface of the dielectric filter in accordance with a second embodiment of the present invention.

FIG. 4 is a front view taken from the open end surface of the dielectric filter in accordance with a second embodiment of the present invention. In the dielectric filter of this embodiment, the smaller diameter portions at the short-circuited end surface 1*b* (not shown) of resonator holes 2*a* and 2*b* having steps 21 are formed furthermost from each other, as shown in FIG. 4. Namely, the width d of smaller diameter portions on the short-circuited end surface 1*b* (not shown) of resonator holes 2*a* and 2*b* is made larger than the width of larger diameter portions on the open end surface 1*a* (not shown). Except this point, the dielectric filter has similar structure as the conventional example shown in FIG. 1, and description thereof is not repeated.

In the structure of FIG. 4, the coupling between the two resonators formed at resonator holes 2*a* and 2*b*, which is originally capacitive coupling because of the steps, is further enhanced and stronger capacitive coupling is obtained. Therefore, the bandwidth is made wider and one attenuation pole is formed in the low frequency range of the pass band.

As described above, by deflecting the central axes of smaller diameter portions of resonator holes having steps from the central axes of larger diameter portions, the distance between the smaller diameter portions of adjacent resonator holes can be changed, whereby the coupling strength between adjacent resonators and the coupling relation, that is, capacitive coupling or inductive coupling, can be changed.

The relationship between the coupling strength and the relation of coupling with respect to the width d of smaller diameter portions will be described with reference to the results of an experiment.

Figure 5:
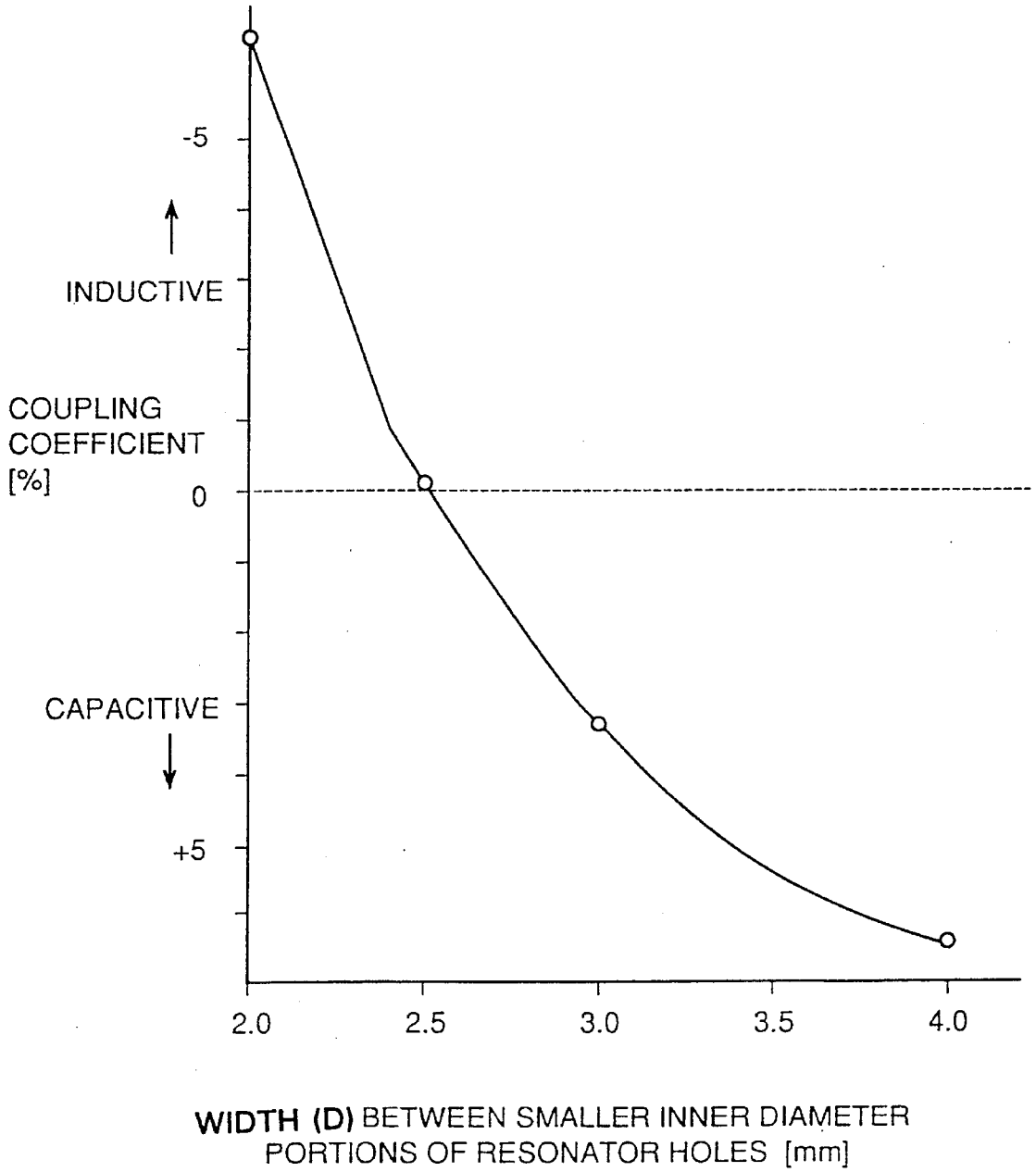
FIG. 5 is a graph showing relation between a width d of smaller inner diameter portions of the dielectric filter, coupling coefficient and relation of coupling in accordance with the present invention.

FIG. 5 is a graph showing the coupling coefficient, coupling relation and the width d of smaller diameter portions of the dielectric filter in accordance with the present invention.

The example of FIG. 5 shows the relation between the width d of smaller diameter portions, coupling coefficient (coupling strength) and coupling relation when two resonator holes are formed in a dielectric block having the thickness 3 mm, width of 6 mm and the length in the direction of the resonator hole of 7 mm, with the diameter of larger diameter portions being 2 mm, the width between larger diameter portions being 3 mm and the inner diameter of smaller diameter portions being 1 mm. Larger diameter portions of the two resonator holes are formed on the side of the open end surface, while smaller diameter portions are formed on the side of the short-circuited end surface.

Referring to FIG. 5, when the width d of smaller diameter portions is equal to the width of 3 mm of larger diameter portions, the coupling between the resonators is capacitive coupling, the strength of capacitive coupling becomes weaker as the width d of smaller diameter portions gradually decreases. Coupling ceases when the width d between smaller diameter portions is about 2.5 mm. When the width further decreases, the coupling changes to inductive coupling, and strongest inductive coupling is obtained when the width d of smaller diameter portions is the smallest (2 mm). By contrast, when the width d between smaller diameter portions is increased, the strength of capacitive coupling increases and strongest capacitive coupling is obtained when the width d between smaller diameter portions is the largest (4 mm).

The above described phenomenon occurs for the following reason. Namely, the ratio of electric field energy related to the coupling between the resonators hardly changes as the width between larger diameter portions of the resonator holes are fixed on the side of the open end surface, while the ratio of magnetic field energy related to the coupling increases/decreases when the width between smaller diameter portions of the resonator holes is changed on the side of the short-circuited end surface. More specifically, with respect to the coupling between the resonators, when the width between smaller diameter portions is decreased, the ratio of magnetic field energy related to the coupling increases, thus increasing the inductive coupling strength, and when the width between smaller diameter portions is increased, the ratio of magnetic field energy related to coupling decreases, and the capacitive coupling strength increases.

Therefore, as in the first embodiment, stable strong inductive coupling can be obtained without the necessity of providing a coupling trench or the like on the outer surface of dielectric block 1. Further, by appropriately setting the width between smaller diameter portions, either capacitive coupling or inductive coupling can be obtained and the coupling strength can also be adjusted. Therefore, desired filter characteristics can be readily obtained.

Figure 6A:
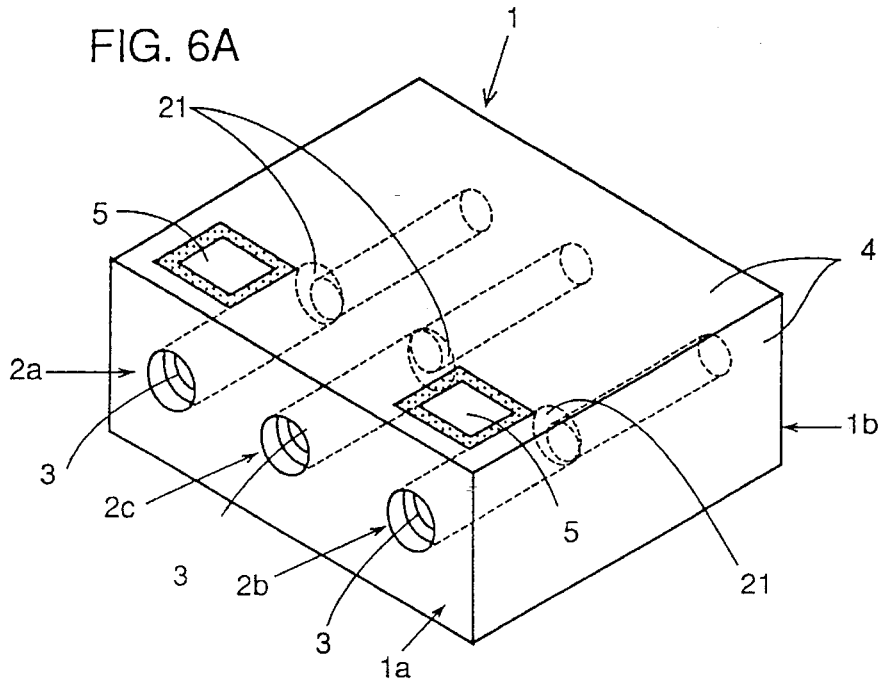
FIG. 6A is a perspective view of a dielectric filter in accordance with a third embodiment of the present invention.
Figure 6B:
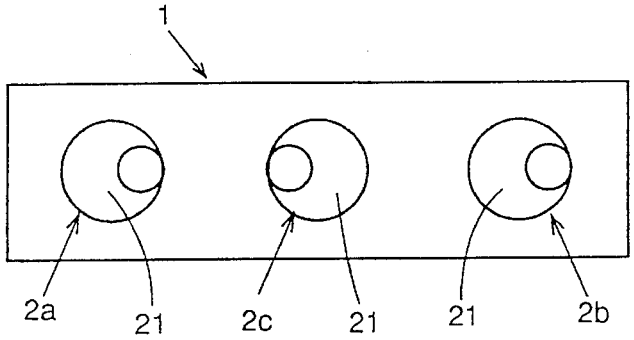
FIG. 6B is a front view taken from the open end surface of the dielectric filter in accordance with the third embodiment of the present invention.
Figure 6C:
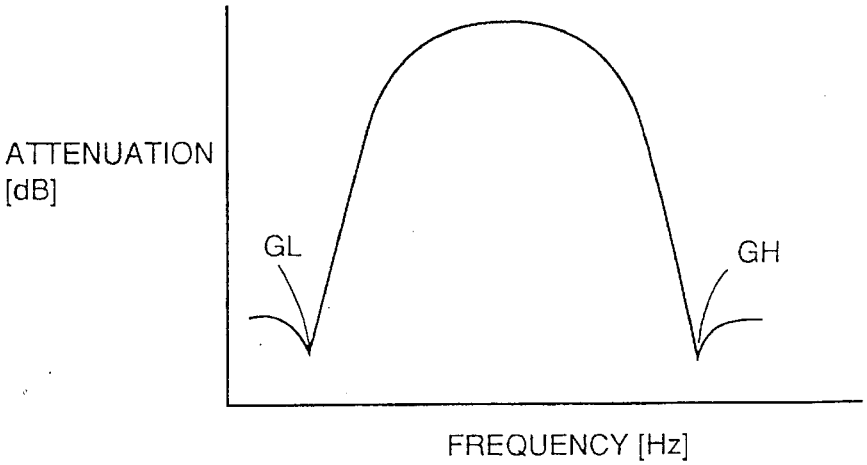
FIG. 6C shows frequency attenuation characteristics of the dielectric filter in accordance with the third embodiment of the present invention.

FIGS. 6A to 6C are related to the dielectric filter in accordance with a third embodiment of the present invention, in which FIG. 6A is a perspective view, FIG. 6B is a front view taken from the open end surface, and FIG. 6C shows the frequency attenuation characteristics.

As shown in FIGS. 6A and 6B, the dielectric filter in accordance with this embodiment includes three resonator holes 2*a*, 2*b* and 2*c* having steps 21 in the dielectric block 1. Resonator holes 2*a*, 2*b* and 2*c* are provided with steps 21 approximately at the center between open end surface 1*a* (FIG. 6A) and short-circuited end surface 1*b* (FIG. 6A), and the inner diameter of resonator holes 2*a*, 2*b* and 2*c* from open end surface 1*a* (FIG. 6A) to the step 21 is made larger than the inner diameter of the holes from short-circuited end surface 1*b* (FIG. 6A) to step 21. Referring to FIG. 6B, the smaller diameter portions at the side of the short-circuited end surface of resonator hole 2*a* serving as one input/output stage and of the resonator hole 2*c* positioned at the center are formed close to each other, while the smaller diameter portions of resonator hole 2*b* serving as another input/output stage and of resonator hole 2*c* at the center are formed apart from each other. More specifically, the width between smaller diameter portions of resonator holes 2*a* and 2*c* is set smallest, while the width between smaller diameter portions of resonator holes 2*b* and 2*c* is made the largest. Except this point, the dielectric filter is similar to the conventional example shown in FIG. 1, and description thereof is not repeated.

In this embodiment, the coupling between two resonators formed by resonator holes 2*a* and 2*c* is the strongest inductive coupling, while the coupling between two resonators formed by resonator holes 2*b* and 2*c* is the strongest capacitive coupling. Therefore, the frequency attenuation characteristic of the filter has maximum bandwidth and two attenuation poles $G_L$ and $G_H$ formed on the low frequency side and on the high frequency side of the pass band, as shown in FIG. 6C.

Figure 2:
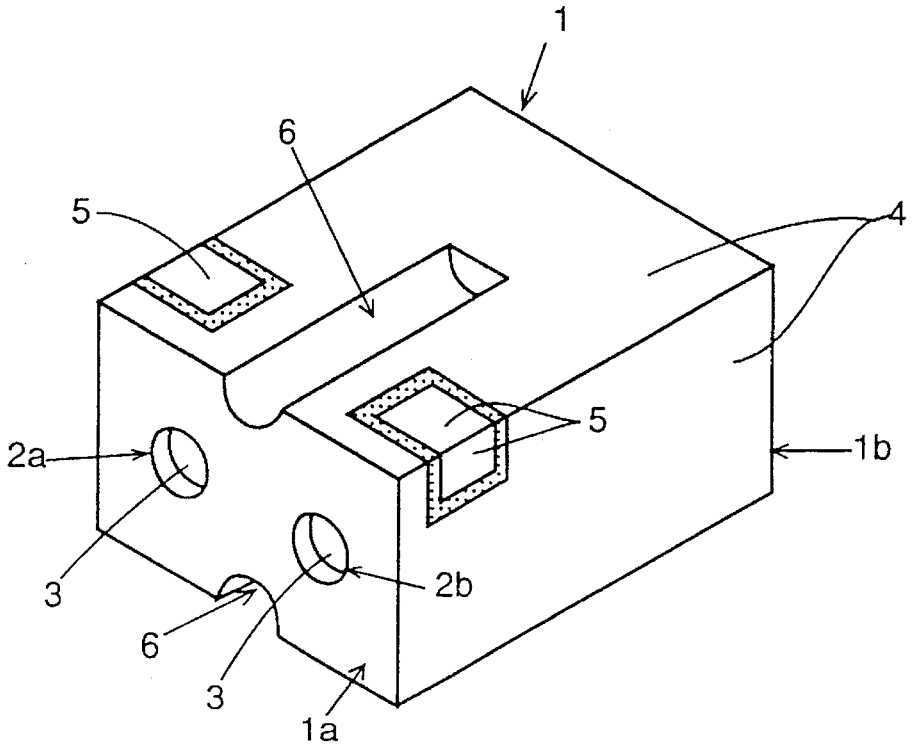
FIG. 2 PRIOR ART
FIG. 2 is a perspective view of a conventional dielectric filter provided with coupling trenches.

In the dielectric filter of the present embodiment, a coupling trench such as shown in the conventional example of FIG. 2 may be provided between the resonator holes 2*a* and 2*c* to further increase inductive coupling strength between the resonators, and hence to obtain a dielectric filter having wider pass band.

Though resonator holes having larger diameter portions on the side of the open end surface and smaller diameter portions on the side of the short-circuited end surface have been described in the embodiments above, the larger diameter portions may be formed on the side of the short-circuited end surface, and the distance between smaller diameter portions on the side of the open end surface may be changed. In that case, the coupling relation between adjacent resonators is reversed to that described above. Namely, when the width of smaller diameter portions is the same as the width of larger diameter portions, the filter provides inductive coupling, when the width of smaller diameter portions is decreased, inductive coupling becomes weaker and changes to capacitive coupling at a certain width of smaller diameter portions, and when the width of smaller diameter portions is increased, the strength of inductive coupling increases.

Though a dielectric filter having a pair of input/output electrodes formed at prescribed positions on the outer surface of the dielectric block has been described in the embodiments above, it is not limited thereto. A resin pin may be provided for connection to outer circuitry, in place of the input/output electrode. Though the inner conductor and the outer conductor are isolated from each other at a location within the resonators near the open end surface, the inner conductor and the outer conductor may be isolated from each other on the open end surface.

Further, although dielectric filters consisting of two and three resonators have been described above, the filter may consist of four or more resonators.

Further, although a $\lambda/4$ resonator having one end of the inner conductor serving as a short-circuited surface has been described in the embodiments above, the present invention can be similarly applied to a $\lambda/2$ resonator having open end surfaces at both ends of the inner conductor serving as the resonator conductor. Further, though the inner conductor is provided on the inner surface of a through hole in the dielectric block, the resonator hole in which the inner conductor is provided may not be a through hole.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A dielectric filter, comprising:

a dielectric block having a pair of opposing end surfaces;

an outer conductor on an outer surface of said dielectric block between said pair of opposing end surfaces;

a plurality of resonator holes piercing through at least one end surface of said dielectric block, each resonator hole having a respective step therein which provides the corresponding resonator hole with a larger inner diameter portion and a smaller inner diameter portion thereof, with a respective central axis of said corresponding smaller inner diameter portion being offset from a respective central axis of said corresponding larger inner diameter portion; and a respective inner conductor on an inner surface of each of said plurality of resonator holes, said respective inner conductors at said corresponding smaller inner diameter portions being connected directly to said outer conductor to define respective short-circuited ends of the corresponding resonators.

2. The dielectric filter according to claim 1, wherein a portion of said respective larger inner diameter portion is tangent to a portion of said corresponding smaller inner diameter portion so that said respective portions are flush with respect to each other along a respective length of said corresponding resonator holes.

3. The dielectric filter according to claim 1, wherein a distance between said central axes of the smaller inner diameter portions of an adjacent pair of said plurality of resonator holes is larger than a distance between said central axes of said corresponding larger inner diameter portions thereof.

4. The dielectric filter according to claim 3, wherein a ring-shaped non-conducting portion, at which the respective inner conductor is not provided, is disposed near one end of each of said plurality of inner conductors, for electrically insulating said outer conductor from said respective inner conductor.

5. The dielectric filter according to claim 1, wherein a distance between said central axes of the smaller inner diameter portions of an adjacent pair of said plurality of resonator holes is smaller than a distance between said central axes of said corresponding larger inner diameter portions thereof.

6. The dielectric filter according to claim 5, wherein a ring-shaped non-conducting portion, at which the respective inner conductor is not provided, is disposed near one end of each of said plurality of inner conductors, for electrically insulating said outer conductor from said respective inner conductor.

7. A dielectric filter according to claim 1, wherein said outer conductor is not provided on one of said pair of opposing end surfaces of the dielectric block, said one of said pair of opposing end surfaces serving as an open-circuited end.

8. The dielectric filter according to claim 1, wherein a ring-shaped non-conducting portion, at which the respective inner conductor is not provided, is disposed near one end of each of said plurality of inner conductors, for electrically insulating said outer conductor from said respective inner conductor.

9. A dielectric filter, comprising:

a dielectric block having a pair of opposing end surfaces;

an outer conductor on an outer surface of said dielectric block between said pair of opposing end surfaces;

a plurality of resonator holes piercing through at least one end surface of said dielectric block, each resonator hole having a respective step therein which provides the corresponding resonator hole with a larger inner diameter portion and a smaller inner diameter portion thereof, with a respective central axis of said corresponding smaller inner diameter portion being offset from a respective central axis of said corresponding larger inner diameter portion; and a respective inner conductor on an inner surface of each of said plurality of resonator holes; wherein at least three of said resonators are provided; and a distance between said central axes of the smaller inner diameter portions of two adjacent resonator holes of said at least three resonator holes is smaller than a distance between said central axes of said corresponding larger inner diameter portions thereof, and a distance between said central axes of the smaller inner diameter portions of another two adjacent resonator holes is larger than a distance between said central axes of said corresponding larger inner diameter portions thereof.

10. The dielectric filter according to claim 9, wherein said plurality of inner conductors each have one end thereof opened to serve as an open end, and the other end thereof connected to said outer conductor to serve as a short-circuited end.

11. A dielectric filter according to claim 9, wherein said inner conductors at said respective smaller diameter portions are connected directly to said outer conductor to define short-circuited ends of the corresponding resonators.

12. A dielectric filter according to claim 9, wherein said outer conductor is not provided on one of said pair of opposing end surfaces of the dielectric block, said one of said pair of opposing end surfaces serving as an open-circuited end.

13. The dielectric filter according to claim 9, wherein a portion of said respective larger inner diameter portion is tangent to a portion of said corresponding smaller inner diameter portion so that said respective portions are flush with respect to each other along a respective length of said corresponding resonator holes.

14. The dielectric filter according to claim 9, wherein a ring-shaped non-conducting portion, at which the respective inner conductor is not provided, is disposed near one end of each of said plurality of inner conductors, for electrically insulating said outer conductor from said respective inner conductor.

15. A dielectric filter, comprising:

a dielectric block having a pair of opposing end surfaces;

an outer conductor on an outer surface of said dielectric block between said pair of opposing end surfaces;

a plurality of resonator holes piercing through at least one end surface of said dielectric block, each resonator hole having a respective step therein which provides the corresponding resonator hole with a larger inner diameter portion and a smaller inner diameter portion thereof, with a respective central axis of said corresponding smaller inner diameter portion being offset from a respective central axis of said corresponding larger inner diameter portion; and a respective inner conductor on an inner surface of each of said plurality of resonator holes; wherein a distance between said central axes of the smaller inner diameter portions of an adjacent pair of said plurality of resonator holes is smaller than a distance between said central axes of said corresponding larger inner diameter portions thereof.

16. A dielectric filter according to claim 15, wherein said outer conductor is not provided on one of said pair of opposing end surfaces of the dielectric block, said one of said pair of opposing end surfaces serving as an open-circuited end.

17. The dielectric filter according to claim 15, wherein a ring-shaped non-conducting portion, at which the respective inner conductor is not provided, is disposed near one end of each of said plurality of inner conductors, for electrically insulating said outer conductor from said respective inner conductor.

18. The dielectric filter according to claim 15, wherein a portion of said respective larger inner diameter portion is tangent to a portion of said corresponding smaller inner diameter portion so that said respective portions are flush with respect to each other along a respective length of said corresponding resonator holes.

19. A dielectric filter according to claim 15, wherein said inner conductors at said respective smaller diameter portions are connected directly to said outer conductor to define short-circuited ends of the corresponding resonators.

20. The dielectric filter according to claim 15, wherein said plurality of inner conductors each have one end thereof opened to serve as an open end, and the other end thereof connected to said outer conductor to serve as a short-circuited end.

21. The dielectric filter according to claim 20, wherein a ring-shaped non-conducting portion, at which the respective inner conductor is not provided, is disposed near one end of each of said plurality of inner conductors, for electrically insulating said outer conductor from said respective inner conductor.

* * * * *